US008965607B2

(12) United States Patent
Heiler et al.

(10) Patent No.: US 8,965,607 B2
(45) Date of Patent: Feb. 24, 2015

(54) DEVICE FOR DREDGING SOIL MATERIAL UNDER WATER

(75) Inventors: Johan Heiler, Zoersel (BE); Jan Gabriel, Mollem (BE); Gwyn Hagenaers, Zwijndrecht (BE); Gert Brouns, Ghent (BE)

(73) Assignee: Tideway B.V., Breda (NL)

( * ) Notice: Subject to any disclaimer, the term of this patent is extended or adjusted under 35 U.S.C. 154(b) by 0 days.

(21) Appl. No.: 13/808,264

(22) PCT Filed: Jun. 28, 2011

(86) PCT No.: PCT/NL2011/050466

§ 371 (c)(1),
(2), (4) Date: Feb. 21, 2013

(87) PCT Pub. No.: WO2012/008829

PCT Pub. Date: Jan. 19, 2012

(65) Prior Publication Data

US 2013/0236273 A1 Sep. 12, 2013

(30) Foreign Application Priority Data

Jul. 16, 2010 (NL) ..... 2005095

(51) Int. Cl.

| | |
|---|---|
| ***G05D 1/00*** | (2006.01) |
| ***B63B 35/30*** | (2006.01) |
| ***E02F 7/10*** | (2006.01) |
| ***B63B 27/34*** | (2006.01) |
| ***B63C 11/42*** | (2006.01) |
| ***E02D 15/10*** | (2006.01) |

(52) U.S. Cl.

CPC . *B63B 35/30* (2013.01); *E02F 7/10* (2013.01); *B63B 35/305* (2013.01); *B63B 35/306* (2013.01); *B63B 27/34* (2013.01); *B63C 11/42* (2013.01); *E02D 15/10* (2013.01)

USPC ..... 701/21; 414/313

(58) Field of Classification Search

CPC ..... E02F 3/8841; E02F 3/9212; E02F 3/92; E02F 3/905

USPC ..... 701/21, 50; 114/312, 244, 36, 114 A; 37/59, 342; 175/103; 242/407; 405/179; 414/137.7

See application file for complete search history.

(56) References Cited

U.S. PATENT DOCUMENTS

2011/0240303 A1 10/2011 Hallundbaek
2012/0000098 A1 * 1/2012 Verboomen ..... 37/333

FOREIGN PATENT DOCUMENTS

EP 0570034 A1 11/1993
EP 0668211 A1 8/1995
EP 2196622 A1 6/2010
GB 2004817 A * 4/1979 ..... B63B 35/00

* cited by examiner

*Primary Examiner* — Thomas G Black
*Assistant Examiner* — Ana Thomas
(74) *Attorney, Agent, or Firm* — The Webb Law Firm

(57) ABSTRACT

The invention relates to a device for dumping material onto an underwater bottom or installation, such as a pipeline. The device comprises a vessel, provided with a fall pipe through which the material is dumped on the underwater bottom; a steering device adapted to control the motion of the fall pipe relative to the underwater bottom; first monitoring means adapted to monitor the state of the underwater bottom; second monitoring means adapted to monitor the position of the steering device; and computing means adapted to compute, control signals for moving the steering device. The invention also relates to a method for dumping material onto an underwater bottom or installation.

17 Claims, 4 Drawing Sheets

DEVICE FOR DREDGING SOIL MATERIAL UNDER WATER

BACKGROUND OF THE INVENTION

1. Field of the Invention

The present invention relates to a device for dumping material onto an underwater bottom or installation, such as a pipeline. The invention also relates to a method for dumping material onto an underwater bottom or installation, as well as to a computer program comprising program instructions adapted to carry out the method.

2. Description of the Prior Art

Flowing media such as oil and gas for instance are typically transported over large distances through pipelines. In order to avoid costly detours, such pipelines may be provided onto the bottom of a sea, which allows to span the shortest distance between two locations. Such pipelines need to be protected adequately and over their entire underwater distance. A useful method to protect pipelines involves dumping (soil) material onto the pipeline, such that the pipeline is actually buried in (soil) material.

A known device for dumping material onto an underwater bottom or installation, such as a pipeline, comprises a vessel, provided with a fall pipe through which the material is dumped on the underwater bottom. The fall pipe is moved along the underwater bottom by the thrust of the vessel. The detailed motion of the fall pipe relative to the underwater bottom is typically controlled by a steering device attached to the lower end of the fall pipe. Such a steering device, also referred to as a Remote Operating Vehicle or ROV in short, is operated manually by vessel personnel.

Dumping materials such as quarry stones for instance at high depths (300 to 600 m are not untypical) and after all also at relatively small depths onto the bottom of the sea involves difficulties such as the influence of currents, movements of the vessel upon violent wind, etc. Since large distances have to covered, it is important to be able to dump the material at the right spot (on top of the pipe line for instance), and also to dump the material efficiently, by which is meant that the desired profile of the underwater bottom has to be reached in as short a time as possible, and by using as little material as possible.

It is an object of the present invention therefore to overcome the drawbacks of the above described prior art device and method, and provide a device and method for dumping material onto an underwater bottom that permits a higher efficiency of operation.

SUMMARY OF THE INVENTION

In one aspect of the invention, there is thus provided a device for dumping material onto an underwater bottom or installation, such as a pipeline, the device comprising:

- a vessel, provided with a fall pipe through which the material is dumped on the underwater bottom;
- a steering device adapted to control the motion of the fall pipe relative to the underwater bottom;
- first monitoring means adapted to monitor the state of the underwater bottom;
- second monitoring means adapted to monitor the position of the steering device relative to the bottom; and
- computing means adapted to compute, on the basis of data obtained from the first and/or the second monitoring means, control signals for moving the steering device.

The device according to the invention allows to promptly and accurately dump material on an underwater bottom or installation, whereby the movement of the fall pipe relative to the bottom is regulated automatically, depending on the actual position of the steering device and the actual state of the bottom.

The invention also relates to a method for dumping material onto an underwater bottom or installation, such as a pipeline, the method comprising the steps of:

- providing a device according to the invention;
- dumping the material on the underwater bottom through the fall pipe of the vessel;
- controlling the motion of the fall pipe relative to the underwater bottom by the steering device;
- monitoring the state of the underwater bottom and the position of the steering device relative to the bottom; and
- computing, on the basis of data obtained from this monitoring, control signals for moving the steering device; and
- moving the steering device (and the fall pipe) in accordance with these control signals.

The method according to the invention is particularly useful in optimizing a dumping operation along one dumping line, i.e. in an embodiment when the vessel is itself moving in a linear fashion. The method of the invention eliminates substantially the variability associated with human action by providing a control loop, in which the steering device motion (and therefore also the motion of the fall pipe, and in particular the motion of the mouth thereof) is controlled in function of its actual position and the actual state of the bottom.

In a further aspect of the invention, a device is provided wherein the computing means are adapted to compute the control signals for moving the steering device such that an optimum criterion is minimized. The optimum criterion can be chosen at will. In a particularly favorable device, the optimum criterion comprises the difference between the actual state of the bottom as measured by the first monitoring means and a desired state of the bottom.

The desired state of the bottom is typically determined before the dumping operation is started, and preferably concerns its desired depth profile. For instance, when a pipeline needs to be protected by covering it with (soil) material, the desired profile would typically be a strip of material with a certain width and height relative to the natural underwater bottom, and following the course of the pipeline. The desired depth of the dumped strip of material is in this example lower than the depth of the natural bottom. The state of the under water bottom, and in particular its depth profile can be determined beforehand by known techniques such as by bathymetry. The depth profile of the bottom during dumping is measured by the first monitoring means.

In another aspect of the invention, a device is provided wherein the first monitoring means comprise an ultrasonic and/or an optical camera. Such first monitoring means are preferably provided onto the lower end of the fall pipe and/or onto the steering device such that their distance to the underwater bottom is not too large. The steering device to this end may be provided with extending structures such as wings up to 5 m and longer, and carrying the first monitoring means. The ultrasonic and/or optical camera are able to locally measure the depth profile of the underwater bottom before, during or after materials have been dumped onto the underwater bottom. Ultrasonic and optical camera means are known per se. A particularly preferred optical camera comprises a multibeam camera, as obtainable from Reson®.

The second monitoring means are adapted to monitor the position of the steering device (and therefore also of the fall pipe and in particular of the lower end of the fall pipe where its mouth is located) relative to the bottom. In this way, the movement of the vessel and/or steering device can be related to the state of the underwater bottom as charted by a survey, which state at least includes the depth profile of the bottom. Indeed a survey carried out before the actual start of the dumping operation yields an initial depth profile of the natural under water bottom and the uncovered installation, such as a bare pipeline. After passage of the fall pipe, and with knowledge of the amount of (soil) material dumped, the new local depth can be calculated. By monitoring the position of the vessel an updated depth profile is obtained. In a preferred aspect of the invention, a device is provided wherein the second monitoring means comprise a global positioning system.

In still another aspect of the invention, a device is provided comprising further monitoring means adapted to measure the flow rate of the material transmitted through the fall pipe and/or the velocity of the vessel. By combining the measured flow rate (in tons/min) with the velocity of the vessel (in m/min), the mass of material dumped per m (in tons/m) can easily be obtained for such a device.

In a preferred method according to the invention the amount of dumped material per meter of movement of the steering device is kept substantially constant. In another preferred method, the amount of dumped material per meter of movement of the steering device is kept substantially constant by regulating the flow rate of material through the fall pipe relative to the velocity of the vessel.

In yet another aspect of the invention, the device comprises an input/output device adapted to transfer the signals from the first and/or the second and/or the further monitoring means to the computing means.

In still another aspect of the invention, the device comprises display units adapted to display the position of the steering device, the vessel and/or the state of the bottom, in particular its depth profile. An operator of the fall pipe vessel is then able to oversee the dumping operation and its progress.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE PREFERRED EMBODIMENTS

Figure 1:
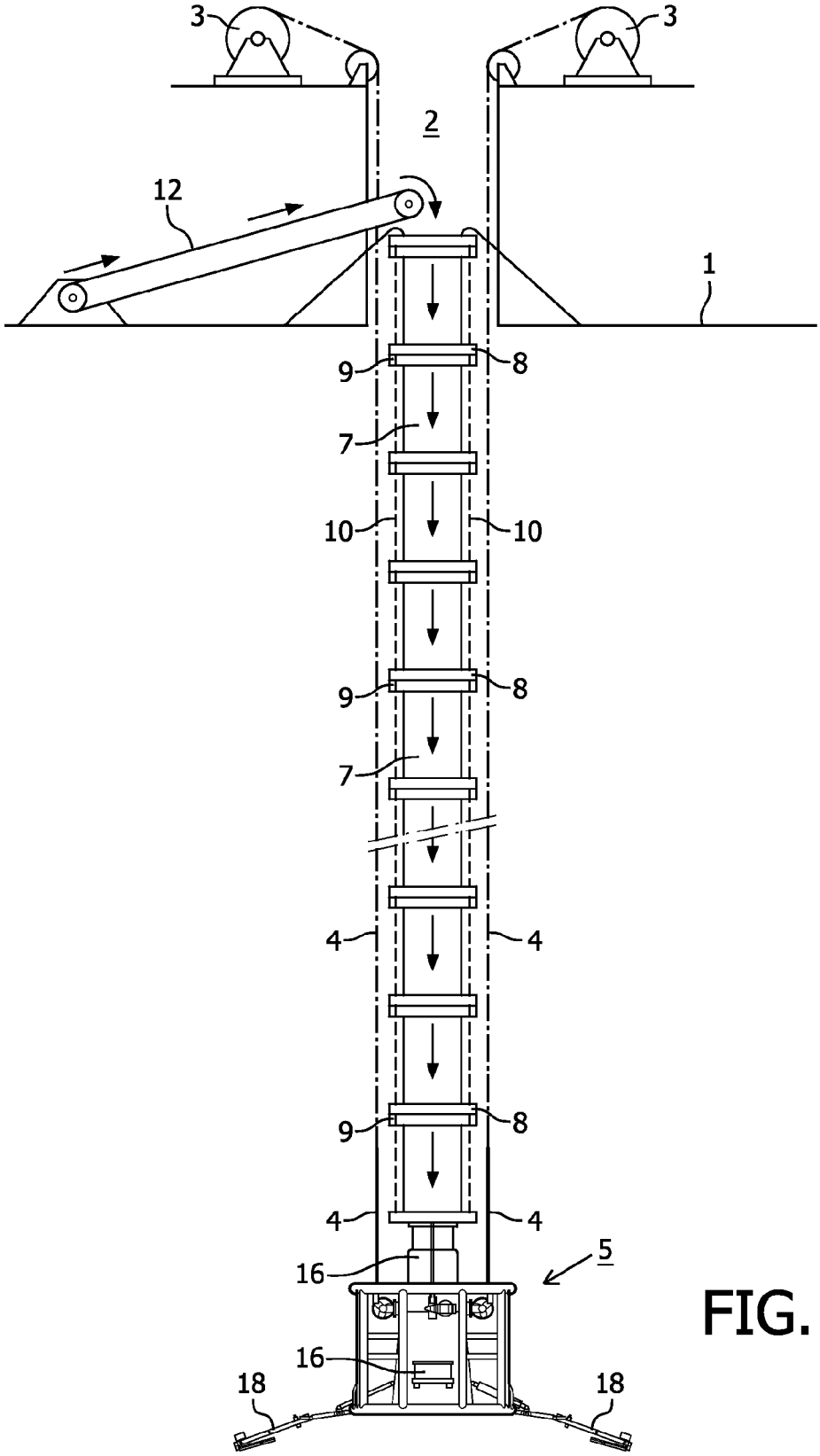
FIG. 1 schematically shows part of a dumping vessel provided with a fall pipe according to the invention.

With reference to FIG. 1 a dumping vessel 1 is shown. The vessel 1 is provided with a fall pipe 2 that extends from the deck of the vessel 1 through the hull of the vessel 1 towards the underwater bottom. At decks height a number of winches 3 are provided that carry a steering device 5 through cables 4. Steering device 5 forms the lower end of the fall pipe 2 and is provided with driving means in the form of motors 6, by which the steering device 5 and thereby also the lower end of the fall pipe 2 can be moved in directions that are substantially perpendicular to the longitudinal axis of the fall pipe 2. The actual fall pipe 2 comprises a series of tubular, more particularly cylindrical pipe elements 7 piled up onto one another and supported by two or possibly more cables 10. Both ends of a cylindrical pipe element 7 are arranged to fit against a corresponding end of an adjacent cylindrical element 7. Each cylindrical pipe element 7 shows at its two ends outwardly directed and abutting flanges (8, 9). If desired, the annular space between abutting flanges (8, 9) of two adjacent pipe elements 7 may be provided with a resilient seal (not shown) in the form of a separate rubber ring or by extending a polymeric inner liner of the pipe elements 7 into the surface abutting on an adjacent element 7. In this way, the fall pipe 2 is provided with a certain elasticity to absorb shocks and the like, and moreover prevents too much water from entering inside the fall pipe 2. The entire fall pipe structure 2 is thus formed by different cylindrical elements 7. These elements 7 are caught over the entire length of the fall pipe 2 between two or more cables 10, which are more particularly fixed to the lowermost element of the fall pipe 2. As a result of the own weight of the different elements, these elements lie onto one another so that heavy connections between the different elements are not required.

The lowermost end of the fall pipe 2 is provided with a steering device 5, also referred to in the art as a "Remote Operated Vehicle or ROV". This remote controllable steering device 5 comprises a central chute 16 which is mounted telescopically with respect to the lowermost elements 7 of the fall pipe 2 and through which the material can be dumped onto the underwater bottom. By means of the cables 4, the heaving movements of the ship can be compensated for in such a manner that the steering device 5 is situated at a constant distance from the underwater bottom. The steering device 5 is provided with folding supporting arms 18, which may extend up to 5 m and further, and are provided with first monitoring means in the form of ultrasonic and/or optical sensors and/or cameras. To control the motion of the steering device 5, and therefore also the correct positioning of the lowermost end of the fall pipe 2, driving means in the form of thrusters 6 are provided on the steering device. The movement of the steering device 5 is controlled by computing means as will be described in more detail further below.

In order to dump material, such as sand or quarry stones for instance, onto the underwater bottom, said material, stored in the holds of the vessel 1, is transported through conveyor 12 to the upper end of the fall pipe 2 and dumped therein, causing said material to fall through the fall pipe 2 and the chute 16 to reach the bottom.

Figure 3:
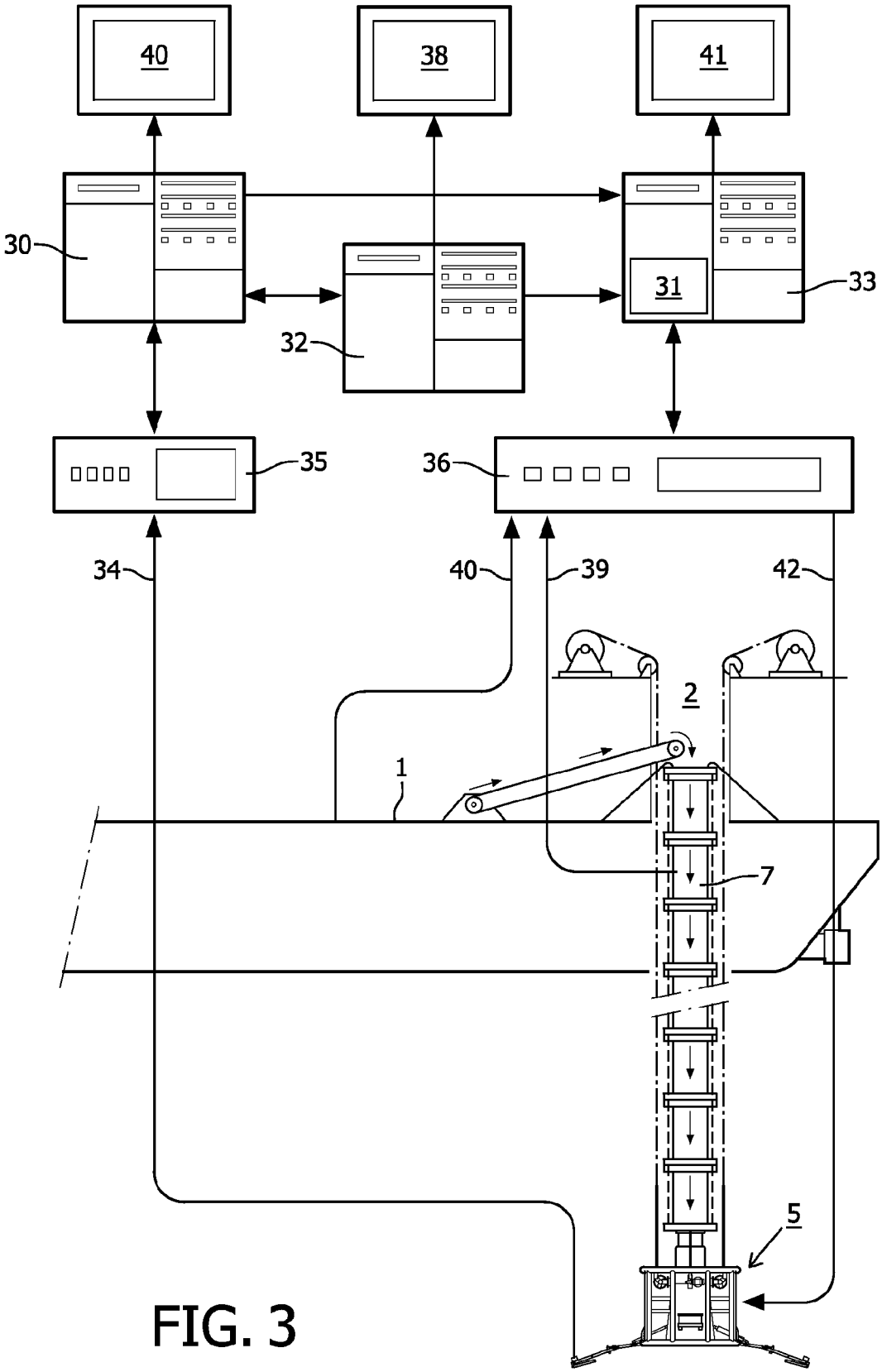
FIG. 3 schematically shows a diagram of the device according to an embodiment of the invention.

With reference to FIG. 3, the device according to the invention is equipped with first monitoring means (17, 30, 35) adapted to monitor the state of the underwater bottom, and in particular the depth profile of the bottom, and second monitoring means 32 adapted to monitor the position of the steering device 5 and/or vessel 1 relative to the bottom. The shown embodiment of the device also comprises further monitoring means 31, adapted to measure the flow rate of the material transmitted through the fall pipe 2 and/or the velocity of the vessel 1, and computing means 33 adapted to compute, on the basis of data (34, 39, 40) obtained from the first, the second, and preferably also the further monitoring means (17, 30, 35, 32, 31), control signals 42 for moving the steering device 5. Transfer of signals from the monitoring means to the computing means can be carried out through wiring (not shown) and/or wireless.

Figure 2:
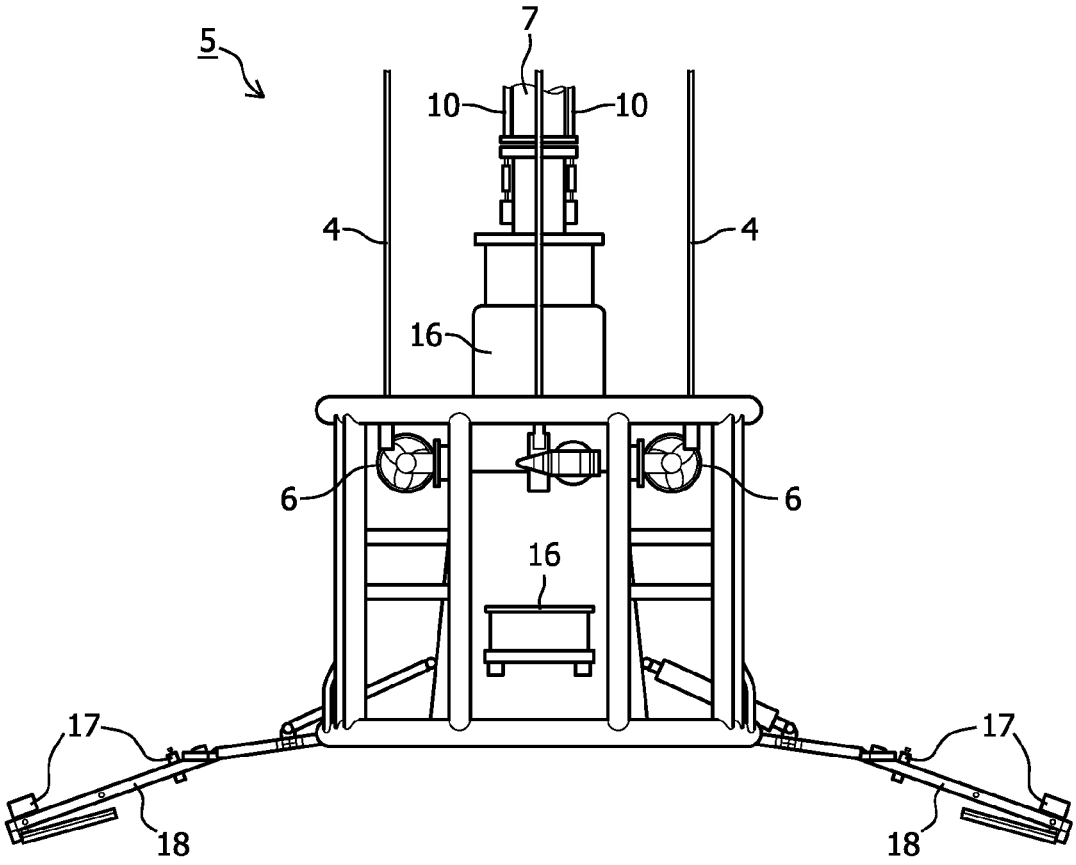
FIG. 2 schematically shows a detailed view of the steering device mounted at the lower end of the fall pipe.

The first monitoring means (17, 30, 35) comprise a number of ultrasonic and/or optical sensors or camera's (17, see FIG. 2), mounted at several positions on the steering device 5, and in particular on the arms 18 thereof. The signals 34 generated by the ultrasonic and/or optical sensors 17 are transmitted through a suitable input/output device 35 to a first monitoring means processing unit 30, at least comprising a memory for storing the depth profile signal data. If desired, the depth profile of the bottom can be visualized for the operator of the fall pipe 2 and/or vessel 1 on a display 40.

The second monitoring means (32, 36) adapted to monitor the position of the steering device and/or the vessel 1 relative to the bottom comprise a dynamic positioning/dynamic tracking (DP/DT) system 32, known per se, an input/output device 36 adapted to transfer position signals from the second monitoring means, as well as signals from the further monitoring means to the computing means 33, and a number of steering device and/or vessel position sensors (not shown). The DP/DT system 32 allows the fall pipe operator to view on-line through a display device 38 a chart of the bottom depth profile. Such a profile is obtained by inputting bathymetric data obtained beforehand in the DP/DT system 32. The depth profile of the bottom is updated in real time as a result of the dumping operation. The DP/DT system 32 also comprises a global positioning system, enabling to locate the global position of the vessel 1 and/or the steering device 5. When a fall pipe 2 is manually operated through its steering device 5, the operator generally relies on the above described set of monitoring equipment. As the operator is working underneath the water level, visibility of the steering device 5 and the fall pipe 2 is poor. The operator therefore needs to rely on a real-time visualization of the position of the vessel 1 and in particular steering device 5, and of the depth profile of the bottom, provided by the first monitoring means (30, 35). When combining this information with a global positioning system signal from the DP/DT system 32, a real-time visualization of the position of the steering device 5 with respect to the depth profile of the bottom is obtained.

According to the invention, the further monitoring means 31 are adapted to measure the flow rate of the material transmitted through the fall pipe 2 and/or the velocity of the vessel 1, and comprise a number of flow rate and/or velocity sensors (not shown), known per se and typically incorporated in the fall pipe 2 and on the vessel 1. The flow rate and velocity signals (39, 40) originating from the sensors are transmitted via the input/output device 36 to the computing means (31, 33) for further processing. If desired, a display unit 41 adapted to display the flow rate and/or velocity signals (39, 40) can be provided.

The computing means 33 are adapted to compute, on the basis of data 34 obtained from the first monitoring means (17, 30, 35) and/or the second monitoring means (32, 36), as well as on the basis of data (39, 40) obtained from the further monitoring means 31, control signals 42 for moving the steering device 5. Control signals 42, generated by the computing means 33 may also be displayed on display unit 41.

Figure 4:
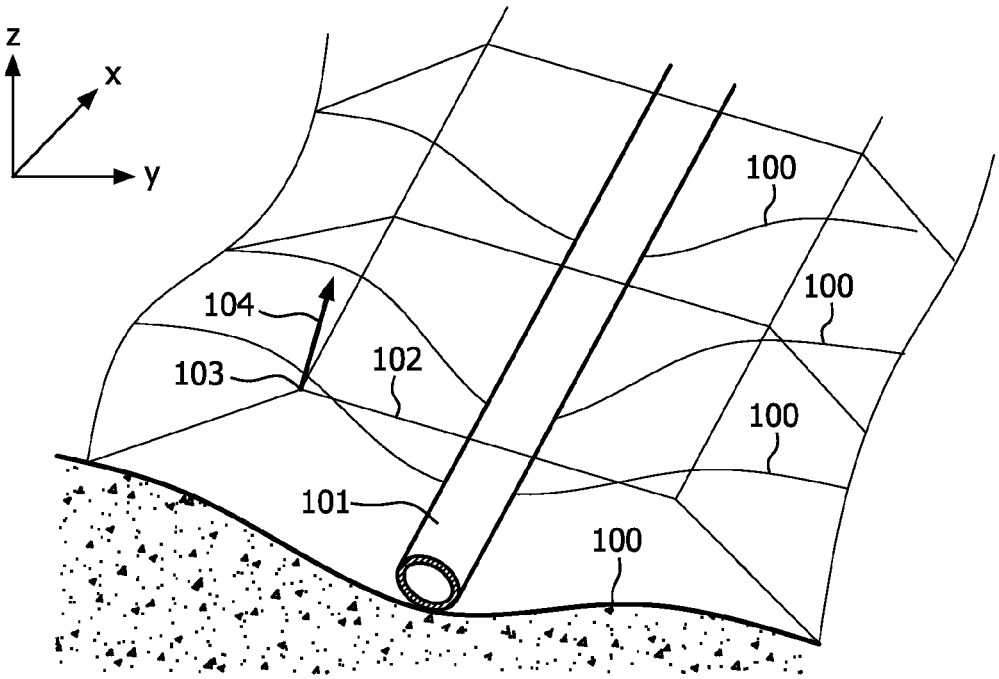
FIG. 4 schematically illustrates a possible scheme for carrying out the method according to the invention.

An embodiment of the invented method for dumping material onto an underwater bottom or installation and using the device described above is now explained in more detail. Typically, a survey of the depth profile of the water bottom is carried out first by taking bathymetric data and store these in the DP/DT system 32. This step yields information regarding the depth profile 100 of the underwater bottom, as well as the position of an underwater installation, such as a pipeline 101, as shown in FIG. 4 in a perspective view. The pipeline 101 extends locally in a direction x, perpendicular to the local cross-sectional directions (y,z). Pipeline 101 need not extend in a linear fashion (as shown) but may be curved for instance. A desired depth profile is known up front and shown in FIGS. 4 and 5 as depth profile 102. Material dumped by a fall pipe 2 will generally accumulate on the bottom as triangularly shaped heaps (102*a*, 102 *b*, . . . ), extending in the direction of movement of the vessel 1. The desired depth profile 102 is therefore approximated by a number of such heaps (102*a*, 102 *b*, . . . ) as shown in cross section in FIG. 5. Please note that the dimensions of the heaps (102*a*, 102 *b*, . . . ) may differ along the longitudinal direction of the pipeline 101, i.e. for different x-coordinates.

Figure 5:
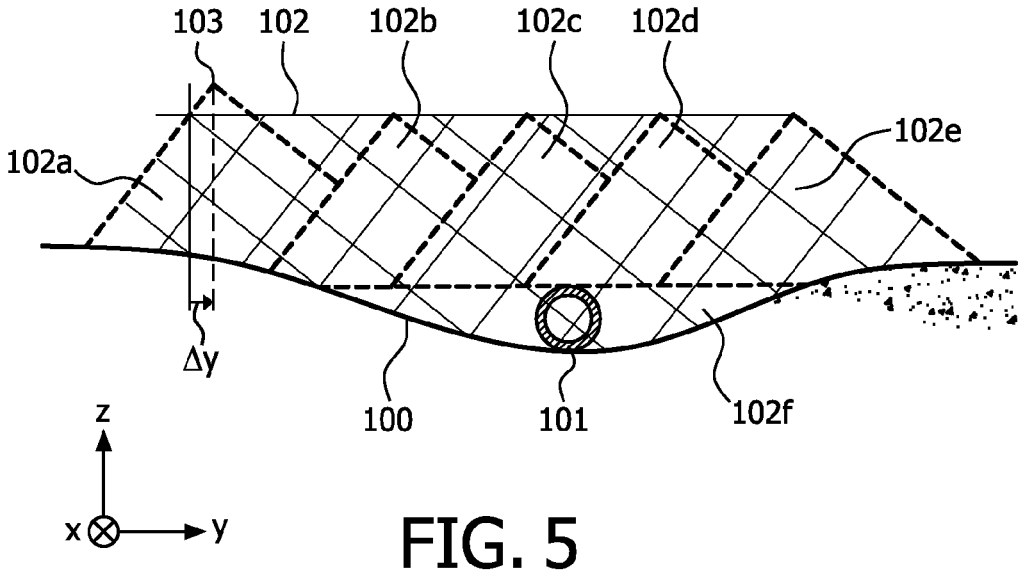
FIG. 5 schematically illustrates the possible scheme of FIG. 4 in a cross-section.

A vessel 1 is then provided with a fall pipe 2 and steering device 5 is brought to a suitable starting location and the fall pipe 2 lowered in the vicinity of the pipe line 101 to be protected, for instance at lateral position 105, as shown in FIG. 5. The vessel 1 is then set in motion in the x-direction with a velocity v, whereby material is dumped through the fall pipe 2 with a flow rate Q. The instantaneous direction 104 of the vessel 1 will in general deviate from the desired direction due to for instance local currents. According to the invention, this deviation is automatically corrected by moving the steering device 5 (and therefore the mouth of the fall pipe 2) over the same amount Δy in the opposite direction (see FIG. 5) so that the mouth of the fall pipe remains at the desired location 103. Desired location line 103 extends in the x-direction and for instance follows the curvatures of the pipe line 101 to remain at the same distance from the pipe line 101. The control signals 42 for moving the steering device 5 are computed by the computing means 33 on the basis of input from the first, second and further monitoring means (17, 30, 35, 32, 36, 31), which comprise at least the instantaneous bottom depth profile signal data and positioning data of the steering device and/or the vessel 1 relative to the bottom, and such that an optimum criterion is minimized. The optimum criterion in the given example comprises the difference between the actual depth profile of the bottom (the initial depth profile being profile 100) as measured by the ultrasonic and/or optical sensors present on the steering device 5, and the desired depth profile of the bottom. At the start of the dumping operation in this specific example, the difference between actual and desired profile is represented and approximated by the assembly of heaps (102*a*, 102 *b*, . . . ). After some material has been dumped, this may be different of course.

Minimizing the difference in this example involves dumping material according to heap 102*a* in the x-direction over a certain distance and then returning in the x-direction to dump heap 102*b*, and so forth. When the amount of dumped material per meter of movement of the steering device 5 in the x-direction is kept substantially constant, a heap (102*a*, 102*b*, . . . ) with substantially the same cross-section A will result. Cross-section A may however be changed by varying the amount of dumped material per meter of x-movement. This can be done by either varying the flow rate Q and/or by varying the vessel velocity v.

The depth profile of the underwater bottom and the position of the steering device 5 relative to the bottom are constantly monitored, as well as the flow rate Q of material through the fall pipe and the vessels velocity v, and these data are fed to the computing means 33 to compute, on the basis of the data obtained from this monitoring, control signals for moving the steering device. The control signals drive the thrusters 6 and their direction, such that the steering device 5 (and the fall pipe 2) is moved in the optimal direction Δy.

A desired dumping profile depends on many properties such as the underwater stability of the bottom and the rheological properties of the dumped material. Other factors that may be important include vessel stability, position control, tidal and water current behavior, and more. The device according to the invention allows to take into account a major part of these parameters by providing a closed loop control system wherein position and depth profile data are combined to compute optimum control signals for moving the steering device. The invention is not limited to the choice of a particular optimum criterion and may actually use any criterion that appears to be useful.

The invention is not limited to any optimization algorithm and many may be used. Such algorithms are generally known to the skilled person and generally minimize some function f(x) subject to a condition such as $h(x) \geq 0$. In the present embodiment the function f(x) comprises the difference in actual and desired depth profile of the underwater bottom along a movement of direction of the vessel. The condition $h(x) \geq 0$ may for instance comprise the condition that the depth h(x) of the fall pipe 2 may not be larger than a certain depth $h_1$, being the actual depth of the underwater bottom. The condition then becomes $h(x)-h_1 \geq 0$ (when depths are given in negative numbers). An optimization scheme is initiated by choosing initial values for x, and compute search directions $\Delta x$, using numerical algorithms such as the well known Newton's method. A step to a new point is then taken and the calculations repeated until the minimum is found. In the context of the present invention, the output of the optimization scheme yields a next movement of the steering device 5 of the fall pipe 2, comprising basically horizontal but sometimes also vertical movement thereof, as well as the speed of movement. It thus becomes possible to maximize throughput and obtain a more even quality. The method and device according to the invention also allow to continuously update the depth profile, previously obtained by the bathymetric data.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A device for dumping material onto an underwater bottom or installation, such as a pipeline, the device comprising:

a vessel, provided with a fall pipe through which the material is dumped on the underwater bottom;

a steering device adapted to control the motion of the fall pipe relative to the underwater bottom;

first monitoring means adapted to monitor the state of the underwater bottom;

second monitoring means adapted to monitor the position of the steering device relative to the bottom;

further monitoring means adapted to measure the flow rate of the material transmitted through the fall pipe and the velocity of the vessel; and computing means adapted to compute, on the basis of data obtained from the first, the second and the further monitoring means, control signals for moving the steering device.

2. The device according to claim 1, wherein the computing means are adapted to compute the control signals for moving the steering device such that an optimum criterion is minimized.

3. The device according to claim 2, wherein the optimum criterion comprises the difference between the actual state of the bottom as measured by the first monitoring means and a desired state of the bottom.

4. The device according to claim 3, wherein the desired state of the bottom concerns its depth profile and the first monitoring means are adapted to measure the depth profile of the bottom.

5. The device according to claim 1, wherein the first monitoring means comprise an ultrasonic and/or an optical camera.

6. The device according to claim 1, wherein the second monitoring means comprise a global positioning system.

7. The device according to claim 1, the device comprising an input/output device adapted to transfer the signals from the first and/or the second and/or the further monitoring means to the computing means.

8. The device according to claim 1, the device comprising display units adapted to display the position of the steering device, the vessel and/or the state of the bottom, in particular its depth profile.

9. The device according to claim 1, wherein the steering device is provided at the lower end of the fall pipe and comprises driving means.

10. A method for dumping material onto an underwater bottom or installation, such as a pipeline, the method comprising the steps of:

dumping the material on the underwater bottom through a fall pipe of a vessel;

controlling the motion of the fall pipe relative to the underwater bottom by a steering device;

monitoring the state of the underwater bottom and, the position of the steering device relative to the bottom, as well as the flow rate of the material transmitted through the fall pipe and the velocity of the vessel;

computing, on the basis of data obtained from this monitoring, control signals for moving the steering device; and moving the steering device (and the fall pipe) in accordance with these control signals.

11. The method according to claim 10, wherein the control signals for moving the steering device are computed such that an optimum criterion is minimized.

12. The method according to claim 11, wherein the optimum criterion comprises the difference between the actual state of the bottom as measured and a desired state of the bottom.

13. The method according to claim 12, wherein the desired state of the bottom concerns its depth profile and the depth profile of the underwater bottom is monitored during dumping.

14. The method according to claim 10, wherein monitoring the state of the underwater bottom is carried out by an ultrasonic and/or an optical camera.

15. The method according to claim 10, wherein the amount of dumped material per meter of movement of the steering device is kept substantially constant.

16. The method according to claim 15, wherein the amount of dumped material per meter of movement of the steering device is kept substantially constant by regulating the flow rate of material through the fall pipe relative to the velocity of the vessel.

17. A computer comprising program instructions for carrying out the method according to claim 10.

* * * * *